US006032319A

United States Patent [19]

Garello

[11] Patent Number: 6,032,319

[45] Date of Patent: Mar. 7, 2000

[54] BATH SPONGE MADE OF PERFUMED POLYETHYLENE NET

[76] Inventor: Carla Garello, Via Branca n.46, 10098 Rivoli (To), Italy

[21] Appl. No.: 09/065,850

[22] Filed: Apr. 24, 1998

[30] Foreign Application Priority Data

Apr. 24, 1997 [IT] Italy ..... T097A0357

[51] Int. Cl.[7] ..... A47K 7/02

[52] U.S. Cl. ..... 15/229.11; 15/104.93; 15/209.1

[58] Field of Search ..... 15/104.93, 104.94, 15/209.1, 229.11, 229.12, 229.13, 222

[56] References Cited

U.S. PATENT DOCUMENTS

| | | | |
|---|---|---|---|
| 3,343,196 | 9/1967 | Barnhouse | 15/229.11 |
| 4,189,802 | 2/1980 | Lansbergen | 15/104.93 |
| 4,462,135 | 7/1984 | Sanford | 15/229.12 |
| 4,969,225 | 11/1990 | Schubert | 15/229.12 |
| 4,987,632 | 1/1991 | Rowe | 15/104.93 |
| 5,144,744 | 9/1992 | Campagnoli . | |
| 5,465,452 | 11/1995 | Girardot | 15/209.1 |
| 5,491,864 | 2/1996 | Tuthill | 15/209.1 |
| 5,507,968 | 4/1996 | Palaikis | 15/229.12 |
| 5,630,245 | 5/1997 | Tuthill | 15/229.11 |
| 5,650,384 | 7/1997 | Gordon | 15/209.1 |
| 5,713,094 | 2/1998 | Markey | 15/229.11 |
| 5,727,277 | 3/1998 | Chien | 15/229.11 |
| 5,727,278 | 3/1998 | Per-Lee | 15/229.11 |
| 5,758,386 | 6/1998 | Chen | 15/229.13 |
| 5,784,747 | 7/1998 | Girardot | 15/229.11 |

*Primary Examiner*—Randall E. Chin
*Attorney, Agent, or Firm*—Ostrolenk, Faber, Gerb & Soffen, LLP

[57] ABSTRACT

The bath sponge (10) is formed of net made of threads of polyethylene material to which at least one substance such as a fragrance, an aroma, a perfume or the like is added. The threads are preferably produced by the extrusion of a mass of polyethylene material incorporating the perfumed substance.

5 Claims, 1 Drawing Sheet

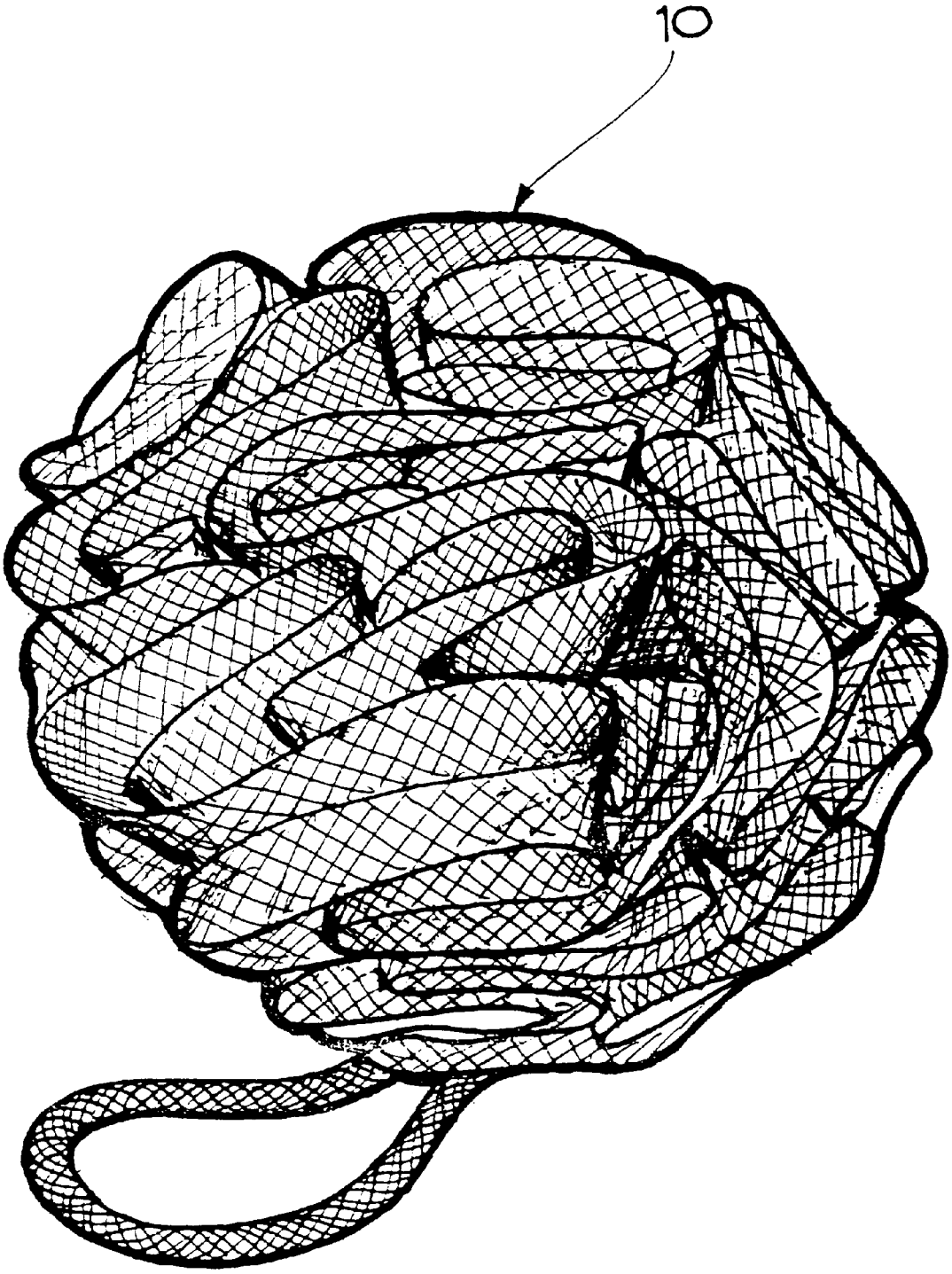
10

BATH SPONGE MADE OF PERFUMED POLYETHYLENE NET

BACKGROUND OF THE INVENTION

The present invention relates to a bath sponge formed of net made of threads of polyethylene material.

Sponges of this type have proved successful in recent years by virtue of the many advantages which they offer. In particular, they are soft and light upon contact with the human body, they can cause mixtures of soap and water to foam rapidly, they can be cleaned completely of residues of foam and dirt simply by rinsing, and they are substantially rot-proof and can therefore ensure a high level of hygiene and have a considerable ability to stand up to prolonged use.

DESCRIPTION OF THE INVENTION

The object of the present invention is to provide a sponge of the type indicated above, the advantageous characteristics of which are further improved in comparison with those listed above.

According to the present invention, this object is achieved by means of a sponge of the type indicated above, characterized in that at least one substance such as a fragrance, an aroma, a perfume or the like is added to the polyethylene material.

The sponge of the invention can thus give off a perfume derived from the particular substance added to the basic polyethylene material, increasing the pleasure and sensation of well-being resulting from its use.

A soap having a synergistic effect with that of the perfumed substance used may advantageously be used together with the sponge.

The threads constituting the net of the sponge of the invention are produced by the extrusion of a mass of polyethylene material incorporating the perfumed substance. The temperature at which the extrusion is carried out is advantageously between 160° C. and 230° C. and preferably about 220° C. so as to ensure that the perfumed substance retains its properties.

BRIEF DESCRIPTION OF THE DRAWING

Further advantages and characteristics of the present invention will become clear from the following detailed description given with reference to the appended drawing, provided purely by way of non-limiting example, in which:

The sole drawing is a perspective view of a sponge according to the invention.

DESCRIPTION OF THE DRAWING

In the drawing, a sponge formed of net made of threads of polyethylene material is indicated 10. A general method of producing a sponge of this type is described in Italian Utility model No. 207 150, the content of which is incorporated herein by reference.

In short, the sponge 10 is made of one or more pieces of tubular net fabric of variable length placed side by side and held together by a tight central tie. The net is produced by the thermal welding of threads superimposed obliquely so as to form rhombic meshes.

After the central tying has been carried out, each lateral portion of each piece of net is opened out and turned over onto the outside manually so that the free end is as close a possible to the central tie. A very light, flexible and highly resilient, rounded and filmy sponge 10 is thus formed.

According to the present invention, the above-mentioned threads are produced by the extrusion of a mass of polyethylene material incorporating a substance such as a fragrance, an aroma, a perfume, or the like.

Any perfumed substance may be used according to specific requirements and, in particular, an essential oil may be used as a vehicle for the perfumed substance. Naturally, a mixture of several different perfumed substances may be used.

The mass to be extruded may also contain any additive known in the art for promoting compatibility of the basic polyethylene material with the perfumed substance and prolonging its release over time.

The sponge thus produced will thus give off a perfume derived from the particular perfumed substance used, which will render its use more pleasing to the user.

Naturally, the principle of the invention remaining the same, the details of construction and forms of embodiment may be varied widely with respect to those described and illustrated purely by way of example, without thereby departing from its scope.

I claim:

1. A bath sponge formed of net made of threads of polyethylene material, characterized in that at least one substance selected from the group consisting of fragrance, aroma, and perfume is incorporated in the polyethylene material.

2. A sponge according to claim 1, characterized in that the threads are produced by the extrusion of a mass of polyethylene material incorporating the substance.

3. A sponge according to claim 2, characterized in that the extrusion is carried out at a temperature of between 160° C. and 230° C.

4. A sponge according to claim 3, characterized in that the extrusion is carried out at a temperature of about 220° C.

5. A sponge according to claim 1, characterized in that an essential oil is used as a vehicle for the substance.

* * * * *